United States Patent [19]

Sanchez

[11] Patent Number: 4,819,534

[45] Date of Patent: Apr. 11, 1989

[54] REMOVABLE KNIVES FOR PUNCHING CARDBOARD SLOTS

[76] Inventor: Frades Sanchez, 3625 E. 10 Ave., Hialeah, Fla. 33013

[21] Appl. No.: 173,659

[22] Filed: Mar. 25, 1988

[51] Int. Cl.[4] ..... B31B 1/22; B26D 3/14

[52] U.S. Cl. ..... 83/671; 83/668; 493/376

[58] Field of Search ..... 83/671, 668; 493/370

[56] References Cited

U.S. PATENT DOCUMENTS

| | | | |
|---|---|---|---|
| Re. 19,059 | 1/1934 | Schillo | 83/671 |
| 725,863 | 4/1903 | McMillin . | |
| 1,027,822 | 5/1912 | Daven . | |
| 1,263,987 | 4/1918 | Wyman | 83/668 |
| 1,493,404 | 5/1924 | Schroeder . | |
| 3,036,486 | 5/1962 | Wilcox | 83/671 |
| 4,073,207 | 2/1978 | Kirkpatrick . | |

*Primary Examiner*—Donald R. Schran
*Attorney, Agent, or Firm*—J. Sanchelima

[57] ABSTRACT

A knife assembly for punching slots on cardboard sheets to allow the subsequent forming of boxes and containers. The knife assembly is substantially a flat arc section with an outer and an inner edge. The outer edge is substantially flat to permit sharp punched edges of the slot. The arc section has two ends and adjacent to one of the ends there is a sharpened section intended to produce a slit termination on the slots punched. The slit can have any desired dimensions including the entire outer edge.

4 Claims, 2 Drawing Sheets

REMOVABLE KNIVES FOR PUNCHING CARDBOARD SLOTS

BACKGROUND OF THE INVENTION

1. Field of the Invention

The present invention relates to knives for punching slots on cardboard blanks, and more particularly, to such machine that include removable knife assemblies.

2. Description of the Related Art

Conventionally, slots are punched on cardboard blanks by passing the latter in between cooperating and opposing wheels. One of these wheels includes one or more removable knife assemblies that penetrate inside a peripheral channel on the opposing wheel. The slots produced conventionally exhibit enlarged openings at the corners proportional to the thickness of the slots. The slots are typically ¼", or preferably ⅜", wide in order to facilitate its handling by the automatic handling machines that bend the cardboard to form the boxes. If the slots are too thin, these automatic handlers jam causing slow downs in production. The wider the slots, however, the wider the openings at the corners. Therefore, a compromise is compelled.

SUMMARY OF THE INVENTION

It is one of the main objects of the present invention to provide a removable knife assembly for punching cardboard slots that permits a thin slit at the end of the slot punched on the cardboard blank sheet.

It is another object of this present invention to provide a removable knife assembly for punching slots in cardboard blanks that can be readily mounted with predetermined dimensions to produce the thinner slot or slit terminations of varying dimensions.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
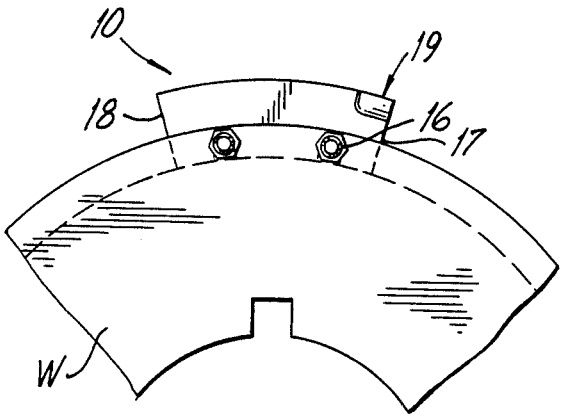
FIG. 1 represents a partially broken section of a wheel where a removable knife assembly in accordance with the present invention is mounted.
Figure 5:
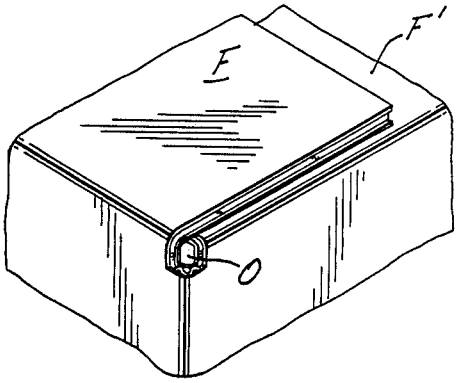
FIG. 5 shows a formed box corner produced with a knife assembly conventionally showing the characteristic undesired opening produced.
Figure 2:
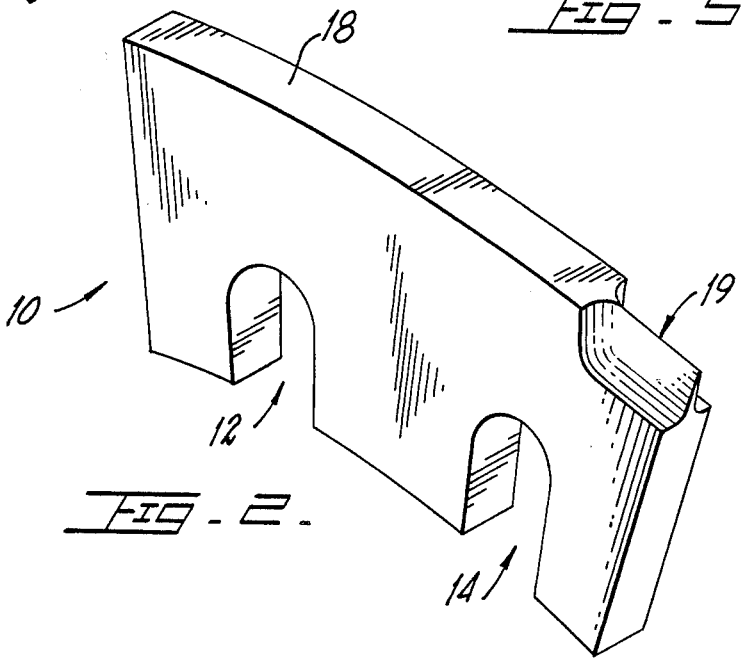
FIG. 2 shows a perspective of the removable knife assembly in accordance with the present invention.
Figure 3:
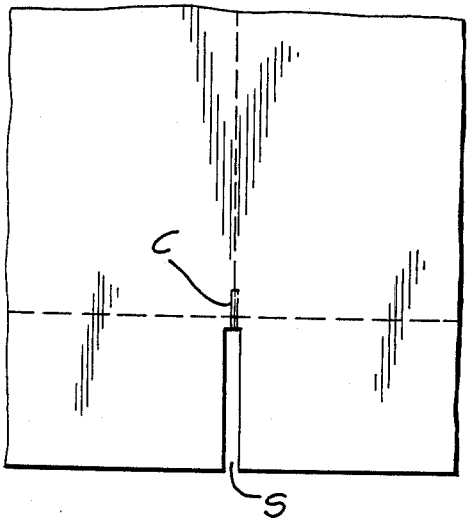
FIG. 3 illustrates a slot produced on a section of a cardboard blank including a thin slit termination.

Referring now to FIGS. 1 and 2, where the present invention is generally referred to with numeral 10, it can be observed that it basically includes a knife assembly in the shape of a flat arc with bays 12 and 14 that cooperate with bolt and nut assemblies 16. Knife assembly 10 has two ends, 17 and 18. Knife assembly 10 is removably mounted on wheel W and it includes an outer edge 18 that punches through the cardboard blank and into an opposing wheel (not shown) to produce the slots S, as shown in FIG. 3. At one end of edge 18, a sharpened section 19 is intended to make a thin termination or slit C on one end of slot S. In some applications, the entire edge 18 can be sharpened instead of just a portion, thereby producing a longer slit C. Also, it is possible to have sharpened section 19 in between the ends, for special applications.

Figure 4:
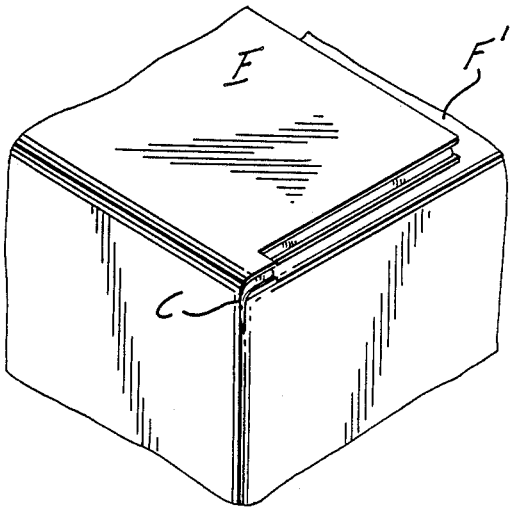
FIG. 4 is a representation of a formed box showing a corner produced with the knife assembly in accordance with this invention.
Figure 6:
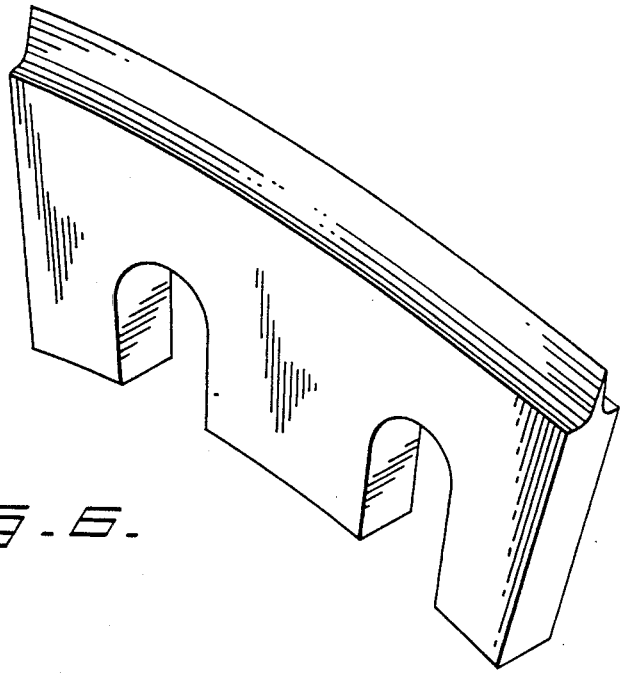
FIG. 6 is a representation of the present invention where the sharpened section extends along the entire outer edge.

The creating of a slit provides a blank cardboard box that can be readily formed by bending the flaps F along the end of slit C, as clearly shown in FIG. 4, without any appreciable openings in the corners. In the conventional manner, on the other hand, flaps F' need to be bent or folded along a line that is slightly above the end of slot S by a distance equal to the width of the cardbox, creating undesired opening O. The dimensions of opening O are proportional to the thickness of the cardboard being utilized.

Another use of the slit C involves the partitions used to separate the boxes inner compartments. With thin cuts or slits C, partition members can be criss-crossed and frictionally held engaged to each other while suspended in the air. This is a desirable characteristic that eliminates handling in automated assembly lines.

It is believed the foregoing description conveys the best understanding of the objects and advantages of the present invention. Different embodiments may be made of the inventive concept of his invention. It is to be understood that all matter disclosed herein is to be interpreted merely as illustrative, and not in a limiting sense.

What is claimed is:

1. A knife assembly for punching slots through cardboard sheets and being removably mounted on a rotating wheel, comprising:

A. a flat arc section having two ends and a flat outer edge for punching slots in said sheet and having an inner end that includes at least one bay, and said outer end including a sharpened section so that a slit terminates the punched slot; and B. fastening means for removably mounting said arc section to said wheel.

2. The knife assembly set forth in claim 1 wherein said sharpened section extends along the entire outer edge of said arc section.

3. The knife assembly set forth in claim 2 wherein said fastening means includes at least one nut and one bolt.

4. A knife assembly for punching slots through cardboard sheets and being removable mounted on a rotating wheel, comprising:

A. a flat arc section having two end, a flat outer edge and an inner flat edge and said inner flat edge includes at least two bays, and said outer flat edge includes at least one sharpened section along said edge so that a slit can be produced at any point along said slot.

* * * * *